US012584386B2

(12) United States Patent
Lagrange et al.

(10) Patent No.: US 12,584,386 B2
(45) Date of Patent: Mar. 24, 2026

(54) PERFORATING GUN WITH DETONATION MODULE

(71) Applicant: OWEN OIL TOOLS LP, Houston, TX (US)

(72) Inventors: Timothy E. Lagrange, Lacombe (CA); Jeffrey Gartz, Lacombe (CA); Jeffrey D. Wood, Keller, TX (US)

(73) Assignee: Owen Oil Tools LP, Houston, TX (US)

( * ) Notice: Subject to any disclaimer, the term of this patent is extended or adjusted under 35 U.S.C. 154(b) by 106 days.

(21) Appl. No.: 17/617,855

(22) PCT Filed: Aug. 21, 2020

(86) PCT No.: PCT/US2020/047406
§ 371 (c)(1),
(2) Date: Dec. 9, 2021

(87) PCT Pub. No.: WO2021/035143
PCT Pub. Date: Feb. 25, 2021

(65) Prior Publication Data

US 2022/0235634 A1 Jul. 28, 2022

Related U.S. Application Data

(60) Provisional application No. 62/889,872, filed on Aug. 21, 2019.

(51) Int. Cl.
*E21B 43/1185* (2006.01)
*F42D 1/05* (2006.01)

(52) U.S. Cl.
CPC ..... *E21B 43/1185* (2013.01); *F42D 1/05* (2013.01)

(58) Field of Classification Search
CPC ..... F42B 3/10; F42B 3/26; F42D 1/02; F42D 1/043; F42D 1/046; F42D 1/05; E21B 43/1185
See application file for complete search history.

(56) References Cited

U.S. PATENT DOCUMENTS 4,850,438 A 7/1989 Regalbuto
8,490,686 B2 7/2013 Rodgers et al.
(Continued)

FOREIGN PATENT DOCUMENTS

WO 2014179669 A1 11/2014
WO 2018183360 A1 10/2018
WO 2020132613 A1 6/2020

OTHER PUBLICATIONS

International Search Report and Written Opinion dated Oct. 23, 2020 issued in PCT/US2020/047406.

*Primary Examiner* — Bret Hayes
(74) *Attorney, Agent, or Firm* — Crowe & Dunlevy, P.C.

(57) ABSTRACT

An apparatus for selectively firing a perforating gun having a plurality of gun assemblies may include an end plate, a portion of a signal communication circuit, an initiator assembly, and an initiating element. The end plate has a cavity formed by at least a first passage intersecting a second passage. The first passage extends from a planar end face of the end plate and the second passage extends from a circumferential surface of the end plate. The portion of a signal communication circuit is disposed in the end plate and conveys signals between the first gun and the second gun. The initiator assembly is at least partially disposed in the first passage. The initiating element is sized to pass through the second passage. The initiating element is also configured to electrically couple to the portion of the signal communication circuit and to thermally couple to the initiator assembly when at least partially seated in the first passage.

10 Claims, 5 Drawing Sheets

(56) References Cited

U.S. PATENT DOCUMENTS

| | | | | |
|---|---|---|---|---|
| 9,080,433 | B2 | 7/2015 | Lanclos et al. | |
| 9,784,549 | B2 | 10/2017 | Eitschberger | |
| 10,036,236 | B1 * | 7/2018 | Sullivan | E21B 43/11855 |
| 10,914,145 | B2 | 2/2021 | Sullivan et al. | |
| 10,920,544 | B2 | 2/2021 | Sullivan et al. | |
| 11,293,736 | B2 | 4/2022 | Eitschberger | |
| 11,377,935 | B2 | 7/2022 | Austin et al. | |
| 11,519,247 | B2 | 12/2022 | Langford et al. | |
| 2012/0037365 | A1 | 2/2012 | Torres et al. | |
| 2012/0199352 | A1 | 8/2012 | Lanclos et al. | |
| 2013/0125772 | A1 | 5/2013 | Backhus et al. | |
| 2013/0133889 | A1 | 5/2013 | Schacherer et al. | |
| 2015/0000509 | A1 * | 1/2015 | Current | E21B 43/11 89/1.15 |
| 2016/0245057 | A1 | 8/2016 | Hardesty | |
| 2018/0299239 | A1 * | 10/2018 | Eitschberger | H05K 5/069 |
| 2020/0332630 | A1 * | 10/2020 | Davis | E21B 43/11855 |
| 2021/0156231 | A1 * | 5/2021 | Sullivan | E21B 43/1185 |

* cited by examiner

PERFORATING GUN WITH DETONATION MODULE

TECHNICAL FIELD

The present disclosure relates to devices and method for perforating a subterranean formation.

BACKGROUND

Hydrocarbons, such as oil and gas, are produced from cased wellbores intersecting one or more hydrocarbon reservoirs in a formation. These hydrocarbons flow into the wellbore through perforations in the cased wellbore. Perforations are usually made using a perforating gun that is generally comprised of a steel tube "carrier," a charge tube riding on the inside of the carrier, and with shaped charges positioned in the charge tube. The gun is lowered into the wellbore on electric wireline, slickline, tubing, coiled tubing, or other conveyance device until it is adjacent to the hydrocarbon producing formation. Thereafter, a surface signal actuates a firing head associated with the perforating gun, which then detonates the shaped charges. Projectiles or jets formed by the explosion of the shaped charges penetrate the casing to thereby allow formation fluids to flow through the perforations and into a production string.

In certain instances, it may be desirable to use switches to selectively fire guns in a perforating tool. The present disclosure addresses the need to more efficiently assemble and/or transport such switches in a downhole tool.

SUMMARY

In aspects, the present disclosure provides an apparatus for selectively firing a perforating gun having a plurality of gun assemblies. The plurality of gun assemblies include at least a first gun and a second gun. The apparatus may include an end plate, a portion of a signal communication circuit, an initiator assembly, and an initiating element. The end plate has a cavity formed by at least a first passage intersecting a second passage. The first passage extends from a planar end face of the end plate and the second passage extends from a circumferential surface of the end plate. The portion of a signal communication circuit is disposed in the end plate and conveys signals between the first gun and the second gun. The initiator assembly is at least partially disposed in the first passage. The initiating element is sized to pass through the second passage. The initiating element is also configured to electrically couple to the portion of the signal communication circuit and to thermally couple to the initiator assembly when at least partially seated in the first passage.

In aspects, the present disclosure provides a related perforating apparatus. The perforating tool may include a first perforating gun having a first carrier having a first interior; a second perforating gun having a second carrier connectable to the first carrier, the second carrier having a second interior, the second carrier further having an opening communicating with the second interior; and a detonation module. The detonation module may include an end plate having a first passage and a second passage; a first electrical contact module positioned at a first end in the first passage; a second electrical contact assembly positioned at a second end in the first passage; and an addressable switch. The addressable switch may be seated in the second passage. The addressable switch includes a body and a seal disposed circumferentially around the body. The addressable switch electrically couples the first electrical contact assembly to the second electrical contact assembly when seated in the second passage. The opening of the second carrier rotationally and axially aligns with the second passage when the end plate is seated in the second carrier interior.

It should be understood that certain features of the invention have been summarized rather broadly in order that the detailed description thereof that follows may be better understood, and in order that the contributions to the art may be appreciated. There are, of course, additional features of the invention that will be described hereinafter and which will in some cases form the subject of the claims appended thereto.

BRIEF DESCRIPTION OF THE DRAWINGS

For detailed understanding of the present disclosure, references should be made to the following detailed description taken in conjunction with the accompanying drawings, in which like elements have been given like numerals and wherein.

DETAILED DESCRIPTION

Figure 1:
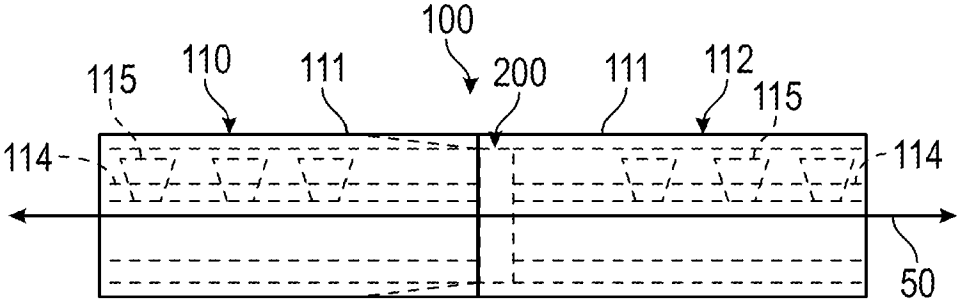
FIG. 1 schematically illustrates a side sectional view of a perforating tool according to one embodiment of the present disclosure.

The present disclosure relates to devices and methods for perforating a formation intersected by a wellbore. The present disclosure is susceptible to embodiments of different forms. There are shown in the drawings, and herein will be described in detail, specific embodiments of the present disclosure with the understanding that the present disclosure is to be considered an exemplification of the principles of the disclosure, and is not intended to limit the disclosure to that illustrated and described herein.

Figure 2:
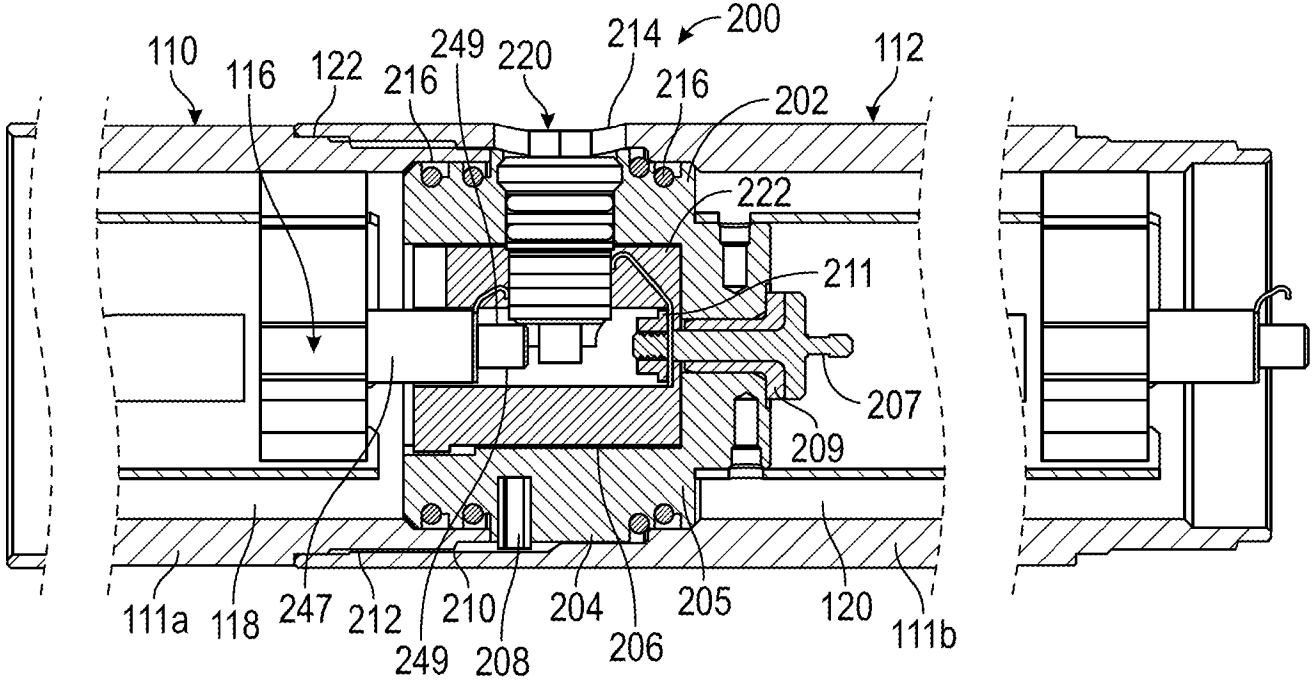
FIG. 2 sectionally illustrates a detonation module in accordance with one embodiment of the present disclosure.

Referring to FIG. 1, there is shown one embodiment of a perforating tool 100 in accordance with the present disclosure. The perforating tool 100 may include a first gun assembly 110 and a second gun assembly 112 aligned in an end to end fashion along a longitudinal axis 50. Each gun assembly 110, 112 includes a carrier 111 that is shaped to receive a charge tube 114. Each gun assembly 110, 112 also includes one or more shaped charges 115 fixed within the charge tube 114. While two gun assemblies are shown, it should be understood that the perforating tool 100 may include three or more gun assemblies. FIG. 2 is directed to a system for selectively firing gun assemblies. However, it should be understood that the teachings of the present disclosure may be applied to perforating tools that do not require selective firing.

Referring now to FIG. 2, there is shown a sectional side view of the perforating tool 100 in accordance with one embodiment of the present disclosure. To selectively fire a gun assembly within the perforating tool 100, a firing signal is sent along a signal communication circuit formed along the perforating tool 100. The firing signal may be an information-encoded signal and/or electrical energy having defined characteristic (e.g., voltage, amperage, duration, polarity, etc.). The signal communication circuit may include a detonation module 200 that is electrically and thermally coupled to the gun assembly 110 and electrically coupled to the gun assembly 112. In some embodiments, the detonation module 200 may be provided with a programmable addressable switch to enable selective firing.

The perforating tool 100 includes guns 110, 112 electrically and thermally coupled to the gun assemblies 110, 112, a signal communication circuit 116, and one or more detonation modules 200. The guns 110, 112 include carriers 111*a*, 111*b*, respectively. The detonation module 200 provides a fluid-tight, pressure isolated environment for the guns 110, 112 and also forms a portion of the signal communication circuit 116 between the guns 110, 112. In an embodiment, the detonation module 200 includes an end plate 202 that is positioned adjacent to a threaded connection 122 between the two guns 110, 112 and seats within the interiors 118, 120 of the guns 110, 112, respectively.

The end plate 202 houses the components used to form the portion of the signal communication circuit 116 between the guns 110, 112. The end plate 202 may include a body 205 in which are disposed a contact pin 207, an electrical insulator 209, and fastener 211. The body 205 may be a cylindrical member having an outer circumferential surface 204, a planar end face 231, and a cavity 206. The end plate 202 may include an alignment key 208 fixed on the outer surface 204 that is complementary to a keyway 210 formed along an inner surface 212 of the carrier 111*b*. The keyway 210 may be a slot, groove, or other similar surface depression that has a specified angular orientation relative to one or more features of the perforating gun 112, e.g., an opening 214 in the circumferential wall of the carrier 111*b*. One or more seals 216 may be disposed on the outer circumferential surface 204 to contact the inner walls of the carriers 111*a,b* and thereby provide an interior of the carriers 111*a, b* that is fluid-tight and pressure isolated. Because the seals 216 are independent and are positioned in each carrier 111*a,b*, the end plate 202 provides a pressure seal between guns 110, 112 that remains sealed when either gun is detonated.

Figure 3:
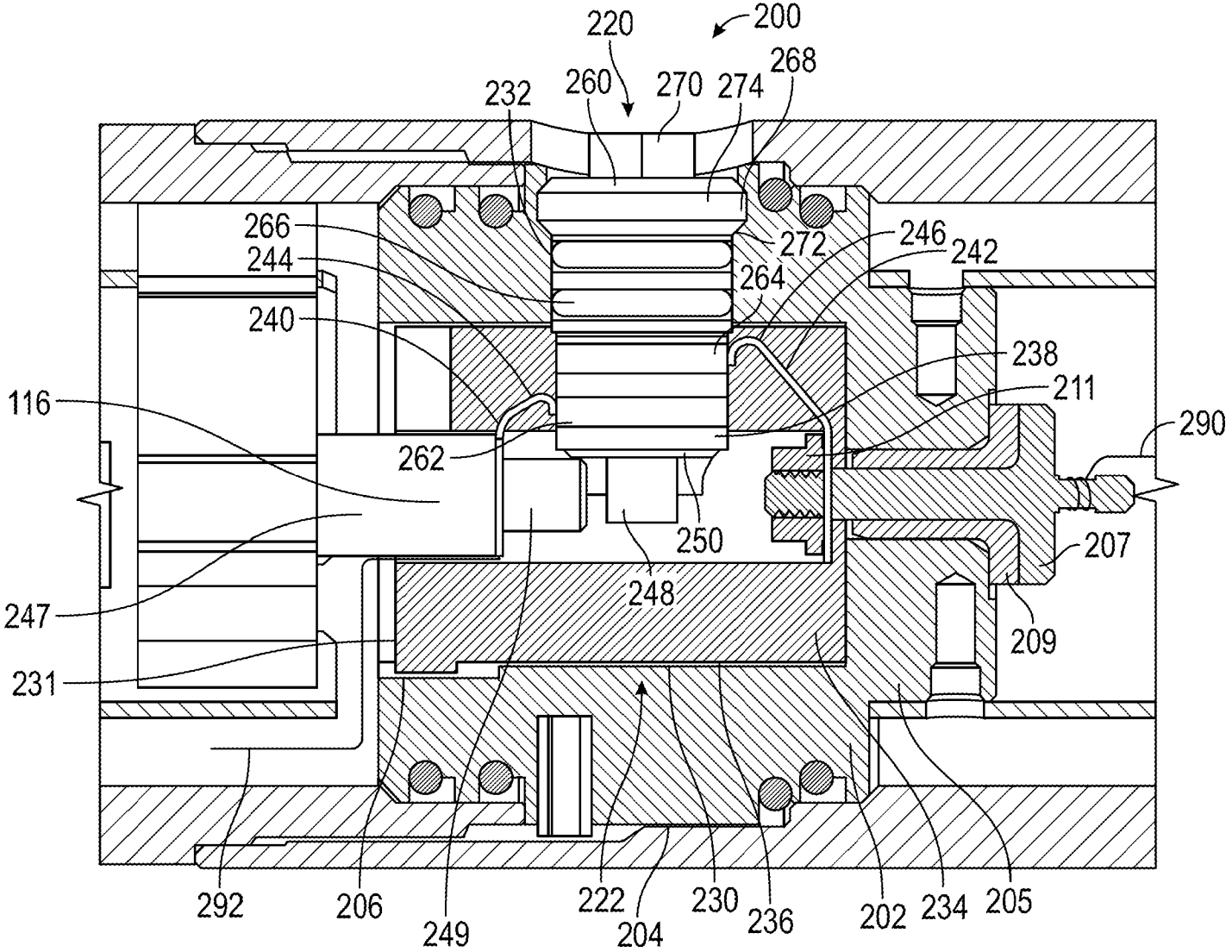
FIG. 3 sectionally illustrates in greater detail a detonation module in accordance with one embodiment of the present disclosure.

Referring to FIG. 3, the detonation module 200 forms the portion of the signal communication circuit 116 by using an addressable switch 220 and a contact module 222. The cavity 206 of the end plate 202 includes a longitudinal passage 230 that intersects a transverse passage 232. The longitudinal passage 230 extends from the planar end face 231 and is shaped and dimensioned to receive the contact module 222 and the transverse passage 232 extends from the circumferential surface 204 is shaped and dimensioned to receive the addressable switch 220. The terms "longitudinal" and "transverse" refer to the direction in which the contact module 222 and the addressable switch 220, respectively, enter the end plate 202. That is, when fully assembled, the longitudinal passage 230 enables physical access, or communication, with the cavity 206 along a direction parallel with the longitudinal axis 50 (FIG. 1) and the transverse passage 232 enables physical access, or communication, with the cavity 206 along a direction that is not parallel with the longitudinal axis 50 (FIG. 1); e.g., perpendicular. The different directions of access to the cavity 206 enable personnel to access the cavity 206 after assembly as discussed below. Thus, the longitudinal passage 230 and the transverse passage 232 may simply be referred to as a first passage 230 and a second passage 232.

The addressable switch 220 may be any conventionally constructed electrical device that, in response to a received signal, can output sufficient thermal energy to detonate an energetic material such as that used in a detonator cord (not shown) or a booster (not shown) and/or transmit, re-transmit, or otherwise convey an electrical signal. One class of switches are considered "select fire" switches because they can be programmed to initiate the firing of one perforating gun of a plurality of perforating guns or the firing of a sub-set of perforating guns of sets of perforating guns. The switch 220 may include analog and/or digital circuitry configured to receive and interpret signals. Interpreting signals may be as simple as recognizing polarity or comparing a received signal with a preprogrammed code or pattern. Irrespective of the configuration, the switch 220 either initiates the firing of the associated perforating gun or passes the signal to the next switch (not shown) based on the received signal.

In embodiments, the switch 220 may have a generally cylindrical body 260 in which are housed electrical circuitry (not shown) for receiving, processing, and transmitting firing signals. Generally, the electrical circuitry (not shown) determine whether a receiving signal is a firing signal for the associated perforating gun, here perforating gun 110 (FIG. 1) or a firing signal for another perforating gun, e.g., a "pass through" signal.

To fire the perforating gun 110 (FIG. 1), the switch 220 includes an initiating element 248 that projects out of an end 250 of the body 260. The initiating element 248 applies activating energy for detonating an end of a detonator cord (not shown) or a booster (not shown) of the perforating gun 110 (FIG. 1) in response to an activation signal (e.g., electrical energy). In some embodiments, the initiating element 248 may be formed of a metal that is resistant to electrical flow and generates heat when electrical current is applied. The initiating element 248 may act directly on and detonate the detonator cord end (not shown), which may be secured in a detonator cord holder 247. In other embodiments, the initiating element 248 may act on the booster charge (not shown), which may be secured in a booster charge holder 249. The detonator cord holder 247 and the booster charge holder 249, if present, may be collectively referred to as an 'initiator assembly.' When fully assembled, the end of the detonator cord (not shown) or booster charge (not shown) may be in physical contact with or spatially separated from the initiating element (not shown). Nevertheless, these components are sufficiently close enough to be detonated by the thermal energy emitted by the initiating element 248. Detonation of the booster charge (not shown) and/or the end of the detonator cord (not shown) carries the detonation to one or more shaped charges 116 (FIG. 1) of the perforating gun 110 (FIG. 1).

Contact pads or rings 262, 264 on the outer surface of the body 260 enable an electrical connection to be established with the electrical circuitry (not shown), to receive signals and to pass through signals, when required. Also, one or more seals 266 are disposed on the outer surface of the body 260 to form a fluid-tight seal with the surfaces defining the transverse passage 232. The body 260 is engaged to the end plate 202 by complementary threads 268 formed on an outer surface of the body 260 and the inner surface defining the transverse passage 232. A bolt head 270 or other suitable projection may be provided to apply torque or otherwise manipulate the body 260.

In an arrangement, the contact module 222 may include a first contact assembly 240 that can be electrically coupled to the perforating gun 110 (FIG. 1) and a second contact assembly 242 that can be connected to the second perforating gun 112 (FIG. 1). In some arrangements, the contact module 222 may include a body 234 in which is formed a cavity 238 that receives the contact assemblies 240, 242. The contact assemblies 240, 242 have ends 244, 246, respectively, exposed to the cavity 238. Each contact assembly 240, 242 may be attached to electrically conductive circuits (not shown) for their associated perforating guns 110, 112, (FIG. 1) respectively. Generally, the signal conducting elements along which a firing signal travels through the perforating tool 100 make up the portion of the signal communication circuit 116.

The perforating tool 100 may be configured such that insertion of the addressable switch 220 and the integrated initiating element 248 into the transverse passage 232 effectively completes physical assembly of the perforating tool 100 and completes the signal communication circuit 116. As noted previously, the signal communication circuit 116 is considered operative or complete if a firing signal can be conveyed along the signal communication circuit 116 between the guns 110, 112. The remaining activities may include programming the addressable switch 220 and activities that do not require access to the interior of the perforating tool 100. In one arrangement, the transverse passage 232 includes a shoulder 272 against which an enlarged diameter portion 274 of the addressable switch 220 seats. The position of the shoulder 272 is selected such that when the addressable switch 220 is seated thereon, the end 244 of the contact assembly 240 physically contacts the contact ring 262 and the end 246 of the contact assembly 242 physically contacts the contact ring 264. Thus, for example, when the addressable switch 220 is threaded into the end plate 202, having the enlarged diameter portion 274 physically contact the shoulder 272 ensures that the contact rings 262, 264 have established electrical connections with their respective contact assemblies 240, 242. When so seated, the signal communication circuit 116 is complete; i.e., capable of transmitting information encoded signals between the guns 110, 112.

Figure 4:
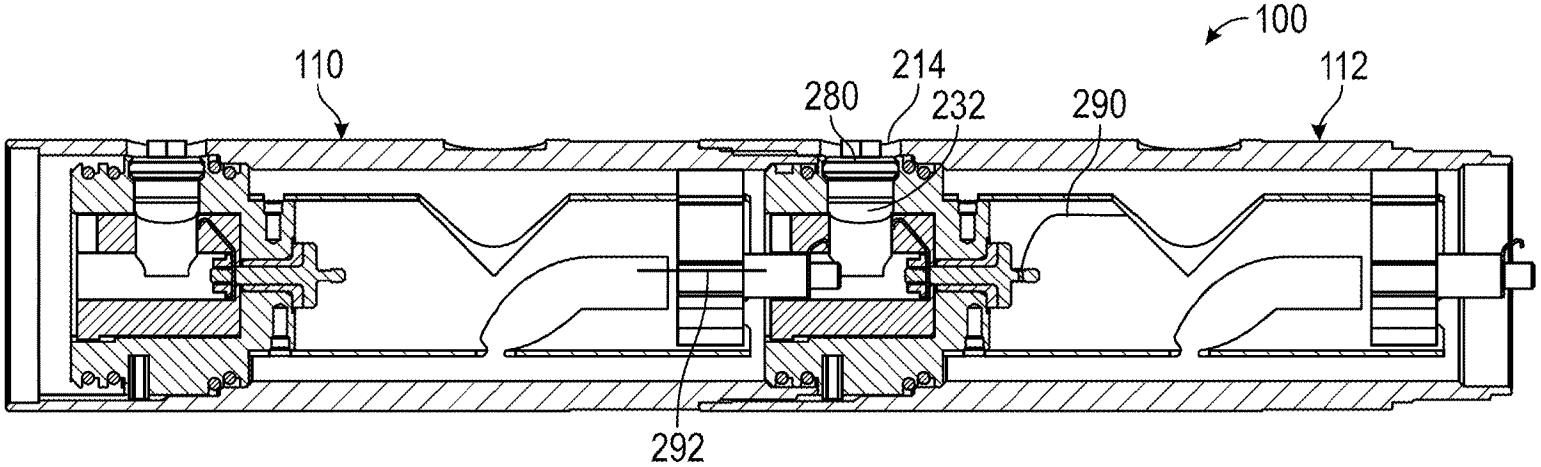
FIGS. 4 and 5 illustrate the FIG. 2 embodiment in different states of assembly.

Referring to FIG. 4, there is shown the perforating tool 100 without the addressable switch 220 (FIG. 3) installed. However, the perforating guns 110, 112 may be otherwise assembled and include shaped charges 115, detonator cords, wiring 290, 292, etc. (not shown). To prevent debris or contaminants from entering the perforating tool 100, a cap 280 may be used to close the opening 214 and/or the transverse passage 232. For example, the cap 280 may be a disc that is press fit into the opening 214 or a lid that is screwed into the transverse passage 232. In some situations, the perforating tool 100 may be configured as shown prior to transport from a manufacturing facility to a well site.

Figure 5:
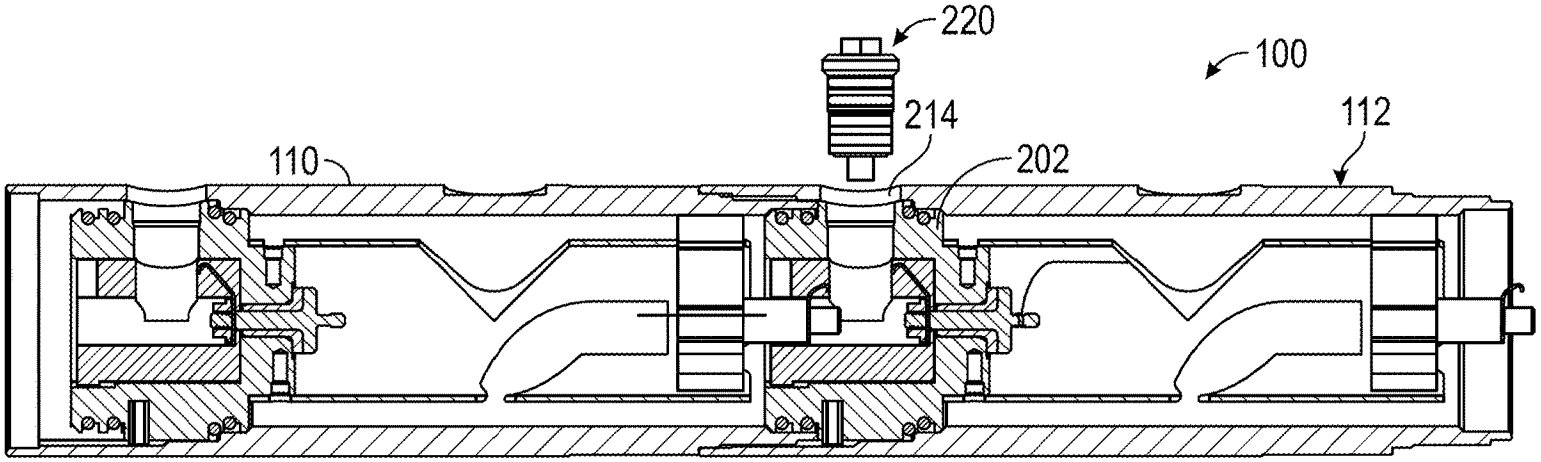

Referring to FIG. 5, after being transported to the well site and in preparation for deployment into a wellbore, the cap 280 of FIG. 4 may be removed and the addressable switch 220 may be installed into the end plate 202 via the opening 214. It should be appreciated that the wiring 290 (FIG. 4) associated with the perforating gun 112 and the wiring 292 (FIG. 4) associated with the perforating gun 110 have already been installed in the perforating tool 100. Furthermore, the perforating gun 110 has already been connected to the perforating gun 112. Thus, the addressable switch 220 has been inserted through the opening 214, which is formed as a window in the circumferential wall of the carrier 111*b* (FIG. 2). Insertion of the addressable switch 220 completes the physical electrical wiring for the signal communication circuit 116 and also positions the initiating element 248 close enough to the initiator assembly (e.g., the detonator cord holder 247 or the booster charge holder 249) to transfer sufficient thermal energy to fire the gun 110. At this point, suitable devices such as a computing device may be used to program the addressable switch 220 with a code or "address" that uniquely identifies the perforating gun 110.

Referring to FIG. 3, upon assembly, a signal from the surface may be communicated along the signal communication circuit 116 to the contact assembly 240 via wiring 292 (FIG. 4) associated with the perforating gun 112 (FIG. 1). The signal travels via the contact assembly 240 and the contact ring 262 to the circuitry (not shown) of the addressable switch 220.

If the circuitry (not shown) determines that the signal is a firing signal for the perforating gun 110, the circuitry (not shown) activates the initiating element 248. If the circuitry (not shown) determines that the signal is not a firing signal for the perforating gun 110, the circuitry (not shown) passes through the signal. By "passing through", it is meant conveying the original signal without any modification, amplifying the original signal, partially processing and passing through the original signal, generating a new signal that carries the same information as the original signal, or combinations thereof. The passed through signal, travels via the physical contact between the contact ring 264 and the contact assembly 242 to wiring 290 associated with the perforating gun 112.

Figure 6:
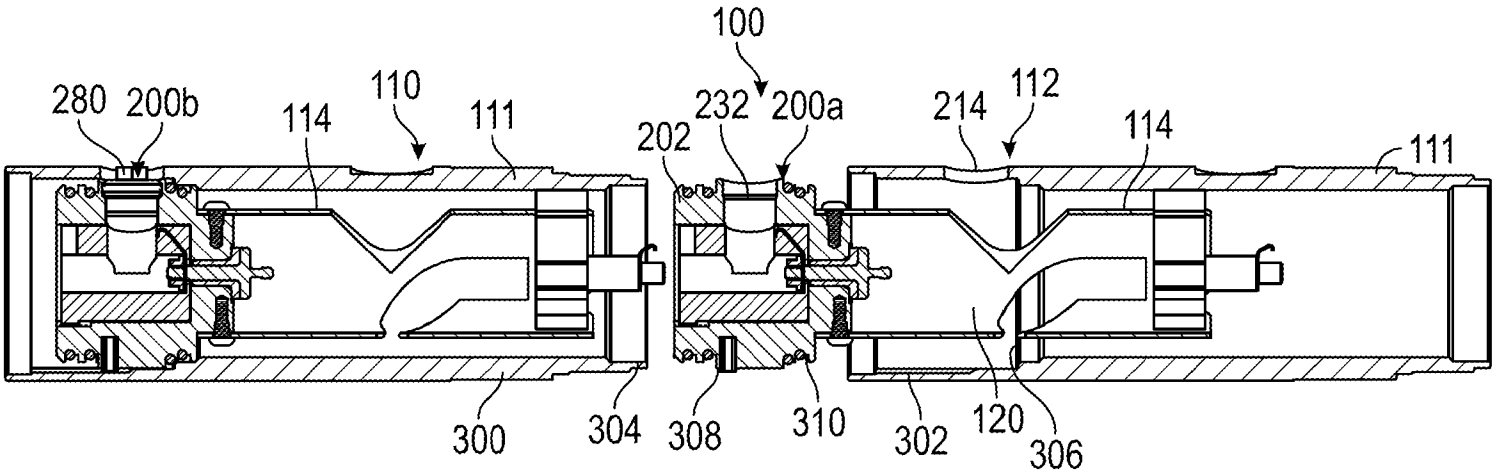
FIG. 6 illustrates an "exploded" view of a perforating apparatus in accordance with one embodiment of the present disclosure.

Referring to FIG. 6, there is shown a side sectional view of the perforating tool 100 with the charge tube partially removed to better illustrate the features of the present disclosure. The perforating tool 100 may include a first gun assembly 110 and a second gun assembly 112. Each gun assembly 110, 112 includes a carrier 111 that is shaped to receive a charge tube 114. Each gun assembly 110, 112 also includes one or more shaped charges 115 (FIG. 1) fixed within the charge tube 114. To selectively fire a gun assembly within the perforating tool 100, detonation modules 200*a,b* are electrically and thermally coupled to the gun assemblies requiring selective firing. The addressable switches 220 (FIG. 2) are not shown. Detonation module 200*b* is shown with the cap 280. While two detonation modules are shown, fewer or greater may be used.

Detonation module 200*a* is shown in an "exploded" view between a pin end 300 of the gun assembly 110 and the box end 302 of the gun assembly 112. The pin end 300 has an circumferential rim 304 and the box end 302 has an circumferential interior shoulder 306. The end plate 202 has a circumferential annular shoulder 308 and a second circumferential shoulder 310. When inserted into the interior 120 of the gun assembly 112, the second circumferential shoulder 310 contacts the circumferential interior shoulder 306. When the pin end 300 is inserted into the box end 302, the rim 304 contacts the first circumferential shoulder 308. When the end plate 202 is compressively secured between the rim 304 and the interior shoulder 306, the opening 214 is rotationally and axially aligned with the transverse passage 232. Thus, an unobstructed path is now available to insert the addressable switch 220 (FIG. 2) into the detonation module 200*a*. It should be appreciated that components internal to the gun assemblies 110, 112 are not disassembled or otherwise disturbed during insertion of the addressable switch 220 (FIG. 2). In particular, the wiring to the detonation module 200 may have already been made at an earlier time.

Figure 7:
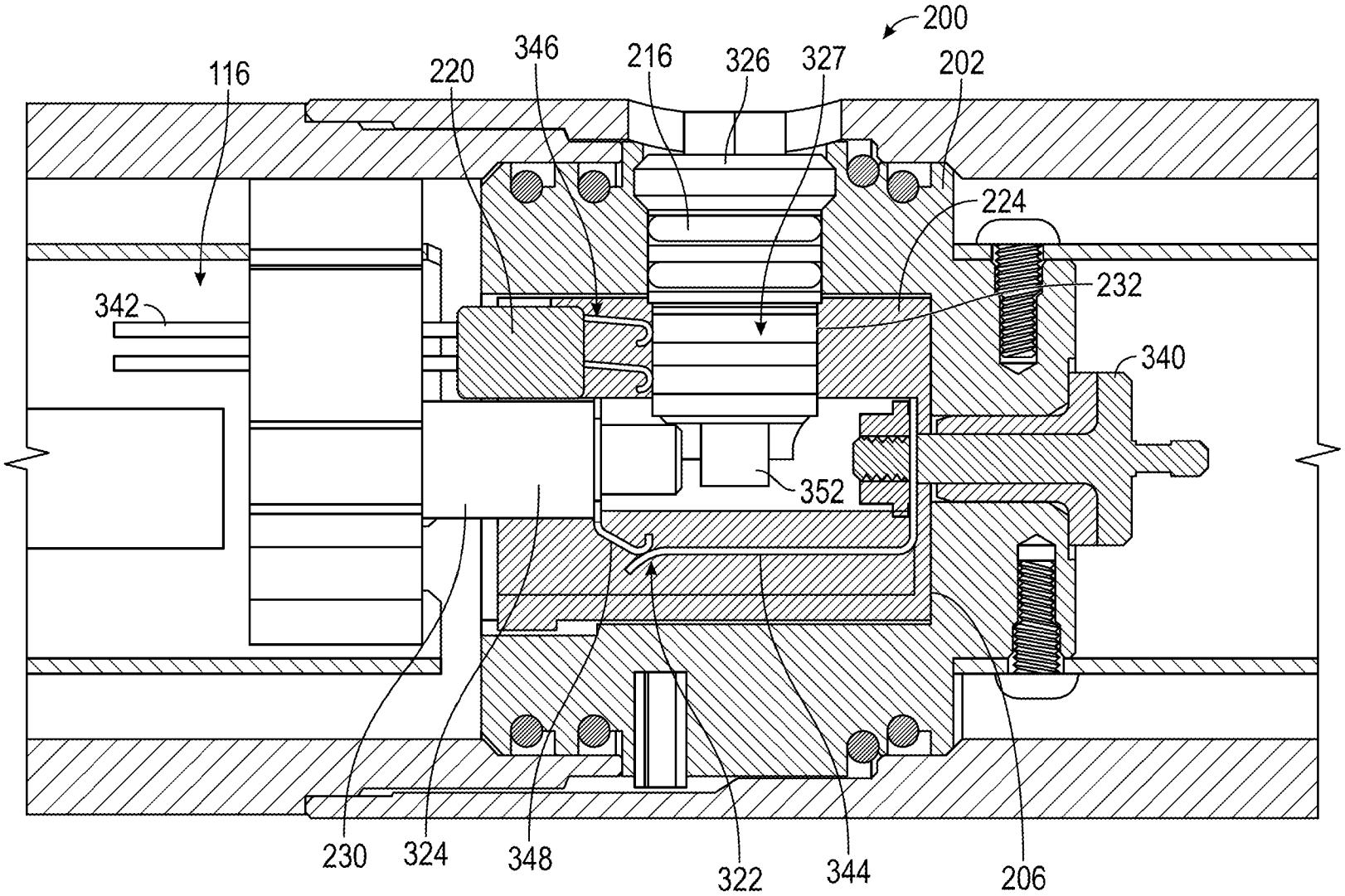
FIG. 7 illustrates another embodiment of a detonation module in accordance with the present disclosure.

Referring to FIG. 7, there is shown another embodiment of a detonation module 200 according to the present disclosure. As in previous embodiments, the detonation module 200 provides a fluid-tight, pressure isolated environment for the guns 110, 112 (FIG. 1) and also forms a portion of the signal communication circuit 116 between the guns 110, 112 (FIG. 1). As also in previous embodiments, the detonation module 200 includes an end plate 202 that is configured in generally the same manner as previously discussed. As discussed below, in the FIG. 7 embodiment, the electrical connections are performed during assembly of the perforating tool 100 (FIG. 1) and the thermal connection may be completed at a later time.

The detonation module 200 forms a signal communication interface by using a contact module 322. In some embodiments, an addressable switch 220 may be used to energize an initiator assembly 324.

In one embodiment, the contact module 322 may include a block 224 disposed in a cavity 206 of the end plate 202. The block 224 includes a first passage 230 that intersects a transverse second passage 232. The first passage 230 is shaped and dimensioned to receive the addressable switch 220 and an initiator assembly 324 and the second passage 232 is shaped and dimensioned to receive a detonator 326.

The contact module 322 may also include an input contact 342 that can be electrically coupled to the perforating gun 110 (FIG. 1) and an output contact 344 that can be electrically connected to the second perforating gun 112 (FIG. 1) via a insulated contact pin 340. The input contact 342 is electrically coupled to the addressable switch 220. Detonator contacts 346 electrically couples the addressable switch 220 to the contacts 327 of the detonator 326. A transfer contact 348 electrically couples the addressable switch 220 to the output contact 344. The contacts 342, 344, 346, 348 may be an assembly of electrical wires, contact pads, clips, biased connections, strips, soldered connections, etc.

In a non-limiting arrangement, the contact 342 may include wires electrically coupled to a contact pin (not shown) associated with the perforating gun 110 (FIG. 1). The contacts 346 may be flexible conductive metal strips that compressively contact the contacts 327 of the detonator 326. The contacts 327 may be circumferential strips positioned to contact the contacts 346 after the detonator 326 is seated in the end cap 202. The contacts 348 and 344 may also be flexible conductive metal strips that compressively contact one another when the addressable switch 220 is seated in the end cap 202.

Generally, the detonator 326 is configured to fire the perforating gun 110 (FIG. 1) by energizing an initiating element 352. The initiating element 352 applies activating energy for detonating an end of the detonator cord (not shown) or a booster (not shown) of the perforating gun 110 (FIG. 1) in response to a activation signal (e.g., electrical energy). The detonator cord end (not shown) and a booster (not shown) may be secured within the initiator assembly 324. One or more seals 216 disposed on the detonator 326 may be used to seal the second passage 232.

The use of the FIG. 7 embodiment is the same as the previously described embodiments of detonation modules.

After being transported to the well site and in preparation for deployment into a wellbore, the cap 280 of FIG. 4 may be removed if present and the detonator 326 may be installed into the end plate 202 via the opening 214 (FIG. 3). It should be appreciated that all internal wiring associated with the perforating guns has already been installed in the perforating tool 100.

In one mode of use, the perforating tool 100 (FIG. 1) is assembled without the detonator 326 and associated initiating element 352. However, the perforating guns 110, 112 (FIG. 1) may be otherwise assembled and include shaped charges, detonator cords, addressable switch 220, the contact module 322, etc. Thus, insertion of the detonator 326 electrically couples the detonator 326 to the addressable switch 220 and thermally couples the initiating element 352 to the initiator assembly 324, which enables the firing of the perforating gun 110 (FIG. 1). It should be noted that access to the internal areas of the perforating guns 110, 112 (FIG. 1) was not needed to complete assembly. Also, suitable devices such as a computing device may be used to program the addressable switch 220 with a code or "address" that uniquely identifies the perforating gun 110. To prevent debris or contaminants from entering the perforating tool 100 (FIG. 1), a cap 280 (FIG. 4) as previously described may be used.

In another mode of use, the perforating tool 100 (FIG. 1) is assembled without the detonator 326 and associated initiating element 352. However, the perforating guns 110, 112 (FIG. 1) may be otherwise assembled and include shaped charges, detonator cords, the contact module 322, etc. The addressable switch 220 may be replaced with an electrical circuit (not shown) that communicates electrical energy to the initiating element 352. Because no addressable switch is used, there is no need to code or "address" any switch. Further, the firing signal may not include information-encoded signals but simply electrical power having defined characteristics (e.g., voltage, time duration, polarity, amperage, etc.). Such embodiments may be used when all guns are to be fired using a single surface transmitted firing signal, when only one gun is used, when one detonation train is used to fire multiple guns, or other situations that do not require selective firing. Insertion of the detonator 326 electrically couples the detonator 326 to the portion of the signal communication circuit 116 and thermally couples the initiating element 352 to the initiator assembly 324, which enables the firing of the perforating gun 110 (FIG. 1). It should be noted that access to the internal areas of the perforating guns 110, 112 (FIG. 1) was not needed to complete assembly. To prevent debris or contaminants from entering the perforating tool 100 (FIG. 1), a cap 280 (FIG. 4) as previously described may be used.

As used in this disclosure, the terms "aligned" means co-linear or concentric. Thus, axes that are aligned are concentric. Axes that are misaligned or eccentric are separated by a predetermined distance. As used in this disclosure, terms such as "substantially," "about," and "approximately" refer to the standard engineering tolerances that one skilled in the art of well tools would readily understand.

As used throughout, an "electrical connection" or "electrical engagement" is a connection wherein electrical signals are conveyed between two or more objects. Physical contact between the two bodies may or may not be present. Also, the terms "gun" and "gun assembly" may be used interchangeably.

By electrically coupled, it is meant that the coupling or connection allows the transfer of information-encoded signals. By thermal connection or thermal coupling, it is meant having the end of the detonator cord (not shown) or booster charge (not shown) sufficiently close enough to an initiating element to be detonated by the thermal energy emitted by the initiating element.

The foregoing description is directed to particular embodiments of the present invention for the purpose of illustration and explanation. It will be apparent, however, to one skilled in the art that many modifications and changes to the embodiment set forth above are possible without departing from the scope of the invention. It is intended that the following claims be interpreted to embrace all such modifications and changes.

What is claimed is:

1. An apparatus for selectively firing a perforating gun having a plurality of gun assemblies, the plurality of gun assemblies including at least a first gun and a second gun, the apparatus comprising:

an end plate having a cavity formed by at least a first passage intersecting a second passage, the first passage extending from a planar end face of the end plate and the second passage extending from a circumferential surface of the end plate;

a portion of a signal communication circuit disposed in the end plate, the signal communication circuit conveying signals between the first gun and the second gun;

a body disposed at least partially in the second passage;

an initiator assembly at least partially disposed in the first passage; and an initiating element projecting from the body, the initiating element configured to electrically couple to the portion of the signal communication circuit and thermally couple to the initiator assembly when at least partially seated in the first passage.

2. The apparatus of claim 1, further comprising a contact module disposed in the end plate, the contact module including:

a first electrical contact electrically connected to the first gun with the signal communication circuit; and a second electrical contact electrically connected to the second gun with the signal communication circuit.

3. The apparatus of claim 1, further comprising an addressable switch disposed in the end plate and electrically connected to the signal communication circuit.

4. The apparatus of claim 3, wherein the addressable switch is disposed in the first passage and wherein the body is associated with a detonator.

5. The apparatus of claim 3, wherein the addressable switch is disposed in the second passage, wherein the body is associated with the addressable switch, and wherein the addressable switch is configured to electrically couple to the portion of the signal communication circuit.

6. The apparatus of claim 1, further comprising: at least one seal circumferentially disposed along the circumferential surface of the end plate.

7. The apparatus of claim 1, wherein the initiator assembly includes at least one of: an end of a detonator cord and a booster charge.

8. A perforating apparatus, comprising:

a first perforating gun having a first carrier having a first interior;

a second perforating gun having a second carrier connectable to the first carrier, the second carrier having a second interior, the second carrier further having an opening communicating with the second interior; and a detonation module including:

an end plate having a first passage and a second passage, the first passage extending from a planar end face of the end plate and the second passage extending from a circumferential surface of the end plate;

a first electrical contact assembly positioned at a first end in the first passage;

a second electrical contact assembly positioned at a second end in the first passage; and an addressable switch seated in the second passage, the addressable switch including a body and a seal disposed circumferentially around the body, the addressable switch electrically coupling the first electrical contact assembly to the second electrical contact assembly when seated in the second passage.

9. The perforating apparatus of claim 8, wherein the detonating module includes a plurality of seals circumferentially disposed around the end plate, the plurality of seals including a first seal forming a seal in the first interior and a second seal forming a seal in the second interior.

10. A method of assembling a perforating apparatus, comprising:

providing a first perforating gun having a first carrier having a first interior;

providing a second perforating gun having a second carrier connectable to the first carrier, the second carrier having a second interior, the second carrier further having an opening communicating with the second interior;

providing a detonation module that includes:

an end plate having a first passage and a second passage, the first passage extending from a planar end face of the end plate and the second passage extending from a circumferential surface of the end plate, wherein the end plate includes: a first electrical contact assembly positioned at a first end in the first passage, a second electrical contact assembly positioned at a second end in the first passage, and a body that includes a portion of a signal communication circuit configured to convey signals between the first electrical contact assembly and the second electrical contact assembly;

positioning a first end of the end plate in the first perforating gun and a second end of the end plate in the second perforating gun;

connecting the first perforating gun to the second perforating gun; and electrically coupling the first electrical contact assembly to the second electrical contact assembly by inserting the body through the opening of the second carrier and disposing the body at least partially in the second passage after the first perforating gun is connected to the second perforating gun.

* * * * *